US005921420A

United States Patent [19]

Gordon et al.

[11] Patent Number: 5,921,420

[45] Date of Patent: Jul. 13, 1999

[54] FIRE PROTECTIVE COVER FOR LIQUID HOLDING CONTAINERS

[76] Inventors: Gerald A. Gordon, 1319 Fairfield Ct., Wheeling, Ill. 60090; John Mikula, 1045 Middlebrook Way, Kennesaw, Ga. 30152; Peter Apostoluk, 131 East Frenchman's Bend, Monroe, La. 71203

[21] Appl. No.: 08/870,163

[22] Filed: Jun. 6, 1997

[51] Int. Cl.[6] ..... B65K 19/00

[52] U.S. Cl. ..... 220/1.5; 220/592.24

[58] Field of Search ..... 220/1.5, 592.24, 220/88.1

[56] References Cited

U.S. PATENT DOCUMENTS

| | | | |
|---|---|---|---|
| 3,589,971 | 6/1971 | Reed . | |
| 3,888,557 | 6/1975 | Anderson et al. . | |
| 4,018,983 | 4/1977 | Pedlow . | |
| 4,249,669 | 2/1981 | Szego . | |
| 4,721,227 | 1/1988 | Hughes et al. . | |
| 4,822,659 | 4/1989 | Anderson et al. . | |
| 4,956,218 | 9/1990 | Haining . | |
| 4,961,509 | 10/1990 | Currier | 220/1.5 X |
| 5,002,194 | 3/1991 | Nichols | 220/1.5 |
| 5,051,290 | 9/1991 | Stober et al. . | |
| 5,091,243 | 2/1992 | Tolbert et al. . | |
| 5,104,700 | 4/1992 | Peterson . | |
| 5,110,000 | 5/1992 | Nichols | 220/1.5 X |
| 5,143,245 | 9/1992 | Malone | 220/1.5 X |
| 5,156,268 | 10/1992 | Nichols | 220/1.5 X |
| 5,259,087 | 11/1993 | Loveless et al. . | |
| 5,305,901 | 4/1994 | Dennig . | |
| 5,407,739 | 4/1995 | McCullough et al. . | |
| 5,654,063 | 8/1997 | Kirk et al. . | |

*Primary Examiner*—Steven Pollard
*Attorney, Agent, or Firm*—Bullwinkel Partners, Ltd.

[57] ABSTRACT

A fire protective cover for protecting from warehouse fires non-metallic liquid holding containers supported by a steel cage is provided. The cover has a heat insulating layer and a heat reflective layer adjacent the heat insulating layer on the side opposite the steel support cage. The cover drapes over the top and sides of the steel cage, creating a space between the cover and the container. The cover mitigates the possibility that the container will melt during a warehouse fire by reducing the heat transfer from the fire to the steel cage and by creating an oxygen depleted zone between the cover and the container.

17 Claims, 2 Drawing Sheets

FIRE PROTECTIVE COVER FOR LIQUID HOLDING CONTAINERS

BACKGROUND

1. Field of the Invention

This patent relates to a means for protecting from fire industrial size liquid holding containers. More particularly, this patent relates to a means for protecting from warehouse fires intermediate bulk containers having a non-metallic inner container supported by a steel cage and resting on a pallet.

2. Description of the Related Art

Industrial size containers for holding liquids (eg., drums, bulk totes and intermediate bulk containers) made from non-metallic materials of construction may be used for transporting flammable and combustible liquids, but they have not yet been approved by appropriate fire protection agencies and insurance underwriters for use in storing such materials in "protected" warehouses. Experience has shown that when intermediate bulk containers, or IBCs, having a steel support cage are exposed to fire, the steel cage heats up, causing a transfer of heat from the steel cage to the plastic inner container exceeding the transfer of heat from the plastic inner container to the liquid contents (acting as a heat sink), resulting in an increase in the temperature of the plastic inner container. If the heat exposure from a fire is great enough, the plastic inner container will melt along those areas where the steel cage contacts the inner container. If failure of the inner container occurs, the flammable contents may spill out and be exposed to the fire, making it extremely difficult to extinguish the blaze. As a result, a significant market for IBCs having inner containers made from non-metallic materials of construction has heretofore been foreclosed, or at least made difficult to serve.

The present invention solves this problem by incorporating a fire protective cover into the IBC design. By maintaining the temperature of the inner container where it contacts the metal support structure at less than melting temperature even in the presence of an intense warehouse fire, the invention allows the survival of the non-metallic IBC inner container for a time sufficient for alternative fire protection means (e.g., sprinklers, fire service personnel with water or foam spray fire suppression equipment) to be deployed.

Fire protective devices are well known in the art. None, however, solves the problem of protecting non-metallic flammable liquid holding containers from warehouse fires. For example, Szego U.S. Pat. No. 4,249,669 discloses a blanket of porous, heat resistant material that floats on the surface of a flammable liquid held within a tank. On ignition of the vapor/air mixture above the liquid the flames recede downwardly until they are extinguished when they reach the blanket. The Szego blanket is not suitable for covering the outside of a steel-cage supported liquid bulk container because, among other reasons, the blanket is porous and allows air to pass through it. By contrast, the present invention requires a nonporous cover which, when exposed to warehouse pool fires, creates an oxygen depleted space between the cover and the liquid holding container.

Peterson U.S. Pat. No. 5,104,700 teaches a fire protective blanket for fireproofing articles such as electrical conductors, cables, pipes, and electric motors. The blanket comprises a plurality of layers of thick but compressible insulative material held together by fasteners that are less resistant to heat than the insulative layers. When the blanket is exposed to heat, the fasteners fail, allowing the blanket to decompress or expand in thickness. This device is not intended for use with flammable liquid holding containers, nor is it suitable as such. Among other things, the Peterson blanket requires a certain minimum thickness in order to achieve its fire protection function, making it unwieldy for use with industrial sized liquid holding containers. By contrast, as will be shown, the present invention requires very little thickness to protect the liquid holding container from heat. Instead, the cover acts in tandem with the liquid contents of the container which operates as a heat sink to keep the container below the temperature at which it will melt or fail.

In brief summary, the fire resistant blankets disclosed in the prior art generally are directed toward keeping flames away from pipes, valves, motors, and other electrical equipment, whereas the present invention is directed toward protecting from fire non-metallic flammable liquid holding containers, particularly those having a metal support cage and resting on a pallet.

Thus it is an object of the present invention to provide a means for protecting non-metallic flammable liquid holding containers from fire which possesses all of the aforenoted advantages.

A further object of the present invention is to provide a fire protective cover that acts in tandem with the contained liquid product/heat sink to keep a non-metallic inner container below the temperature at which the inner container will melt.

A still further object of the present invention is to provide a fire protective cover that, when exposed to typical warehouse fire conditions, creates an oxygen depleted space between the cover and the inner container.

Another object of the present invention is to provide a fire protective cover that requires less insulating capacity and is thinner than conventional fire protective covers, thus allowing ease of installation and removal and ease of storage when the covers are not in use.

Another object of the present invention is to provide a fire protective cover for non-metallic liquid holding containers that is easy to manufacture and economical to use.

Yet another object is to provide a fire protective cover that is suitably thin so that the containers being protected may be stacked one on top of another under standard warehouse storage conditions.

Further and additional objects will appear from the description, accompanying drawings, and appended claims.

SUMMARY OF THE INVENTION

The present invention is a combination fire protective cover and non-metallic container for holding flammable liquids. The non-metallic container may be a drum, bulk tote, intermediate bulk container, or other suitable container. Where the non-metallic container is an IBC, the IBC may comprise an inner container, usually made of plastic, a rigid support cage typically made of steel, and a pallet. In one common type of IBC, the inner container is supported on at least its vertical sides by the rigid support cage. An optional molded pulp pad may be interposed between the inner container and the pallet to protect the bottom of the inner container from direct contact with flames.

In one embodiment used with IBCs, the fire protective cover is configured to drape over the steel cage, thus covering the top and the steel cage supported sides of the inner container. The cover may comprise a heat insulating layer and a heat reflective layer adjacent the heat insulating layer on the side away from the steel cage supported sides. The cover reflects heat and insulates the steel cage to keep the steel cage from heating and melting the plastic inner container at those areas where the cage contacts the inner container.

Typically, the IBC is used to store and transport a flammable liquid which, when the IBC is exposed to high warehouse fire temperatures, acts a heat sink, thereby working in tandem with the cover to keep the steel cage from melting the inner container.

In the preferred embodiment there is a space between the installed cover and the inner container. When exposed to a floor fire, flammable vapors rise into this space from below to deplete the oxygen, providing further protection by mitigating the possibility of fire occurring in that space.

The pallet provides for ease of movement. The pallet may be made of steel, plastic, wood, or other suitable material, and the covered IBCs may be stacked on top of one another.

THE DRAWINGS

DETAILED DESCRIPTION OF THE INVENTION

Figure 1:
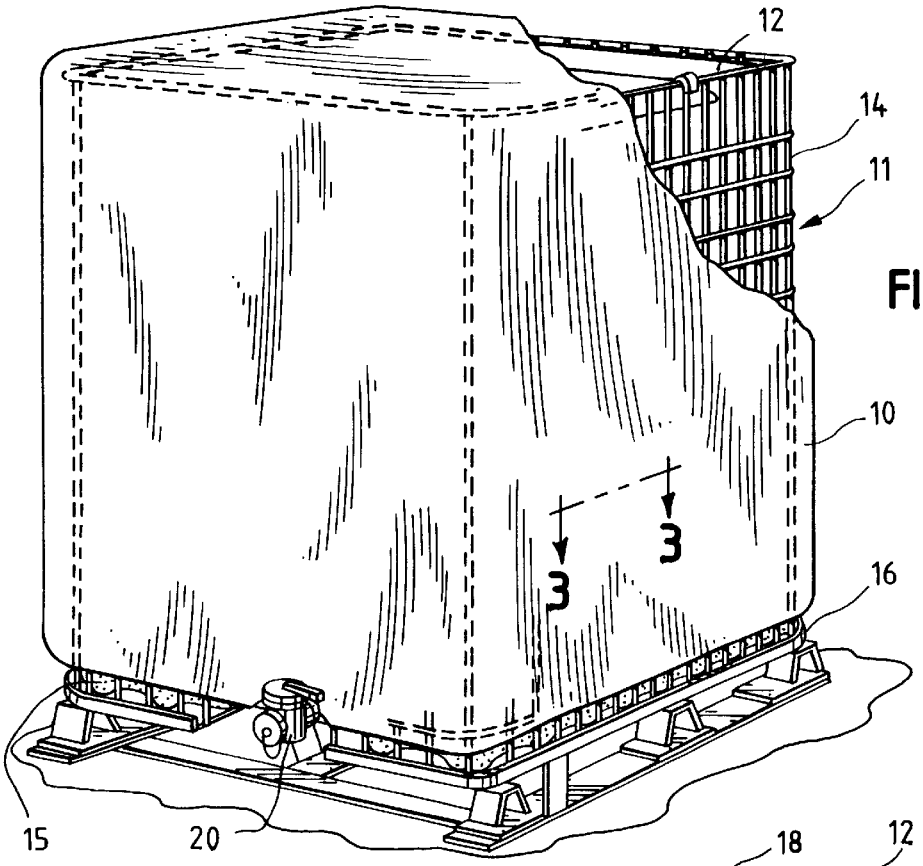
FIG. 1 is a perspective view of the preferred embodiment of the present invention, partially cutaway to show the plastic inner container and steel support cage.

Turning to the drawings, there is shown in FIG. 1 one embodiment of the present invention, showing a fire protective cover 10 draped over an intermediate bulk container, or IBC 11. Although the fire protective cover may be used with drums, bulk totes, bottles, or other liquid holding containers, for purposes of illustration an intermediate bulk container will be discussed.

The IBC comprises an inner container 12 surrounded and supported by a steel cage 14 and resting on a molded pulp support pad 15 which in turn rests on a pallet 16. The inner container 12 may be made from non-metallic materials such as high density polyethylene (HDPE) or other plastic, fibre, or composite materials. The support pad 15 protects the plastic inner container 12 from puncture on impact, and also prevents direct impingement of flame onto the bottom of the inner plastic container 12.

Figure 2:
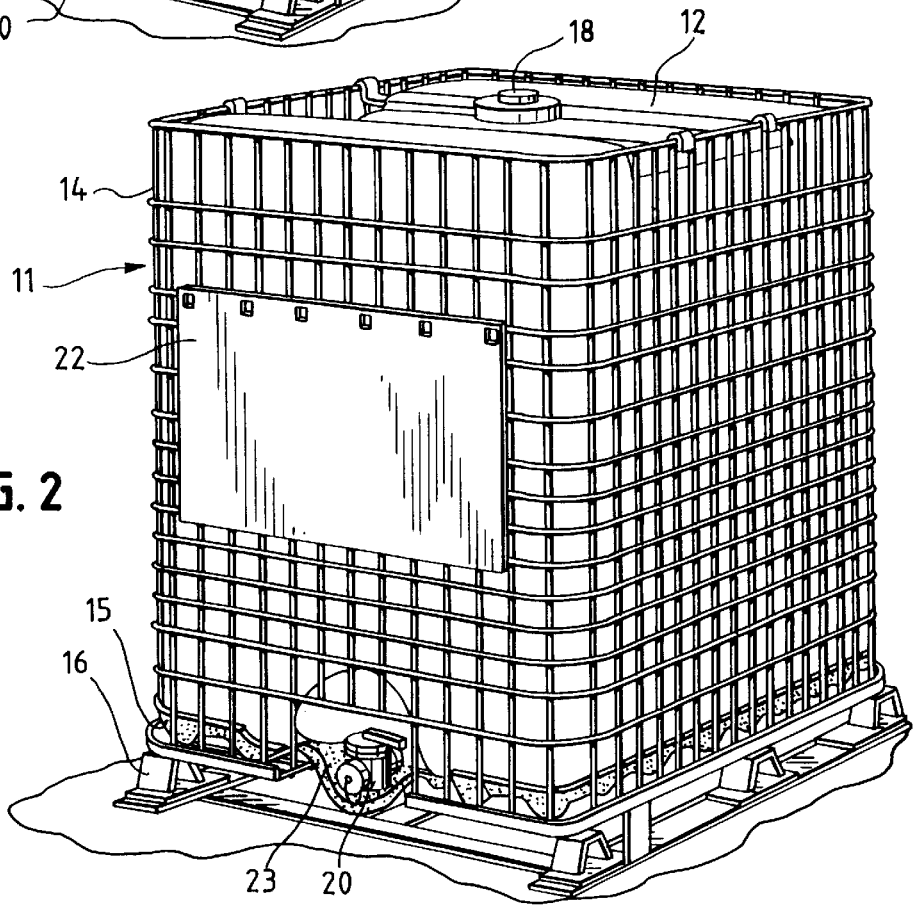
FIG. 2 is a perspective view of one common type of intermediate bulk container (IBC) without the fire protective cover.

IBC's may be used in place of conventional drums to reduce filling, dispensing, handling, storage and disposal costs. Liquid contents may be poured in through a fillport 18 located on the top of the inner plastic container 12, shown in FIG. 2, and discharged through a valve 20 located near the bottom. The support pad 15 may comprise a portion 23 extending under the valve 20 to shield the valve 20 from flames during a fire, as shown in FIG. 2. A marking plate 22 may be located on the front of the IBC 11 for easy product identification.

The welded steel reinforced cage 14, molded pulp support pad 15 and steel pallet 16 are used to provide strength, protection, and ease of transport. IBC's may be stacked three high due to the interlocking feature of the steel cages and pallets.

As shown in FIG. 1, the fire protective cover 10 is draped over the IBC 11 to substantially cover its top and sides. It is anticipated that the cover 10 will be placed over incoming IBCs when they are delivered to a warehouse and removed before the IBCs are shipped out. If desired, a smaller separate or integrated fire protective cover (not shown) may also be used to protect the inner container discharge valve 20, which otherwise might be exposed to a pool fire. When not in use, the fire protective covers 10 can be easily stored by folding and stacking them or, in the case of a second embodiment described below, hanging them on storage hooks.

Figure 3:
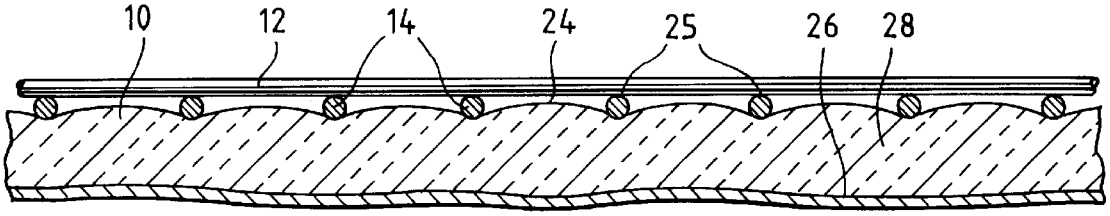
FIG. 3 is a cross-sectional view of the present invention taken along line 3—3 of FIG. 1.

A significant feature of the invention is that the bottom of the cover 10 is left open and a space is maintained between the cover 10 and the inner container 12. Because the cover 10 is draped over the steel support cage 14 and not the inner container 12 itself, a space or gap 24 is left between the cover 10 and the inner container 12 (FIG. 3). A chief advantage of this feature is that the air space 24 acts as an additional insulator inhibiting conductive heat transfer to the inner container 12.

A further advantage of maintaining a space 24 between the cover 10 and the inner container 12 is that, in the presence of a floor or pool fire, hot vapors are allowed to rise and fill the space 24, puffing or billowing out the protective cover 10 and depleting the oxygen in the space 24 which inhibits combustion of the vapors in the space 24.

Yet another advantage of this configuration is that, should a sprinkler system (not shown) be set off by the fire, any water draining into the space 24 between the cover 10 and the inner container 12 will tend to vaporize to steam, further depleting the oxygen in the space 24 while at the same time cooling the inner plastic container 12 by removing heat in the form of the water 's latent heat of vaporization.

FIG. 3 shows a cross-sectional view of the present invention taken along line 3—3 of FIG. 1. As is readily apparent from the figure, the steel cage 14 can and does contact the inner container 12 along certain areas 25. When the IBC 11 is exposed to fire, the heat transferred by contact from the steel cage 14 to the inner plastic container 12 can cause the container 12 to melt at these contact areas 25 were it not for the protective cover 10.

In the embodiment shown in FIG. 3, the fire protective cover 10 comprises two layers, a heat reflective layer 26 and an insulating layer 28, although it is anticipated that these layers may be one in the same. The heat reflective layer 26 is located adjacent the heat insulating layer 28 away from the inner container 12 and minimizes the radiative heat transfer to the container 12 and/or the steel support cage 14. As can be readily seen, the fire protective cover 10 drapes over the steel support cage 14, not the inner container 12, providing the advantages heretofore described.

The heat reflective layer 26 may be made from metal foil, foil laminate, or other suitable material. The heat insulating layer 28 may be made from fiberglass, a crosslinked polyethylene foam, DuPont NOMEX®, or other suitable material.

Significantly, the fire protective cover 10 requires very little thickness to insulate the inner container 12 from heat. This is because the insulative qualities of the fire protective cover 10 are not the sole means by which the inner container 12 is protected from heat due to fire. The contents of the inner container 12 also help protect the container 12 from heat by acting as a heat sink to help keep the container 12 below the temperature at which it will melt. In other words, the heat transfer from the inner container 12 to its liquid contents helps offset the heat transfer from the steel cage 14 to the inner container 12, all of which keeps the container 12 below melting temperature.

Because the cover 10 works in tandem with the container 12 contents to maintain the temperature of the container 12 at a level below the container melting point, the cover 10 need not have the insulating ability it might otherwise require. As a result, the cover can be made conveniently thin. Thinner covers are easier to install and remove, are easier to store when not in use, and are more economical to use for large numbers of containers.

As has been described, the fire protective cover 10 has at least two important functions. First, it helps keep the temperature of the steel support cage 14 low by reflecting heat and insulating the steel cage 14 from heat due to fire.

Second, the cover 10 helps create an oxygen depleted space between it and the container 12, thus keeping fire away from direct contact with the container 12.

Figure 4:
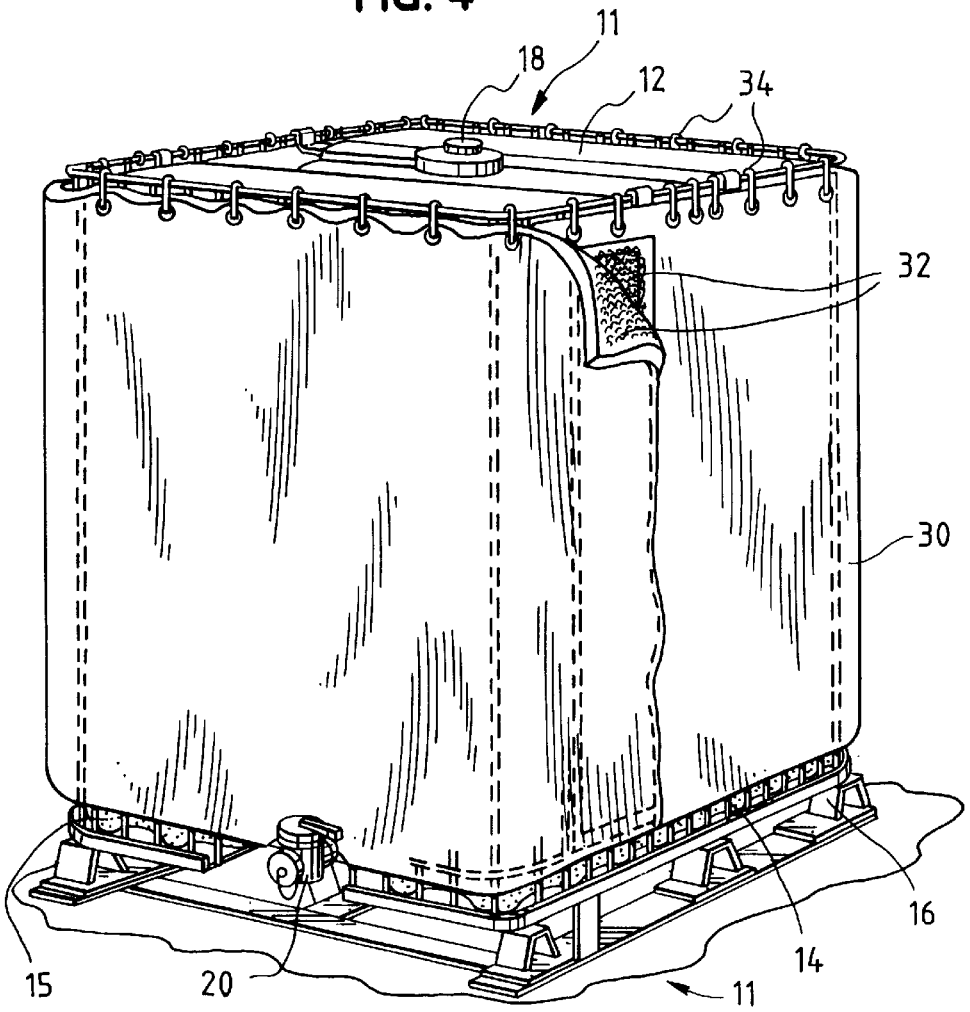
FIG. 4 is a elevational view of a second embodiment of the present invention.

In a second embodiment shown in FIG. 4, the fire protective cover 30 is substantially rectangular and does not have a top section. This embodiment might be used in instances where a top cover is not desired, such as when the IBCs 11 are closely stacked on top of one another.

In this second embodiment, the ends of the rectangular cover 30 comprise fastening means 32 for fastening one end of the cover 30 to the other end. In the embodiment shown, hook and loop type fasteners such as Velcro® are used. This second embodiment also comprises means for attaching or hanging the fire protective cover from the top of the steel cage 14. Hooks 34 may be used for this purpose, although any suitable attachment means may be used.

Other modifications and alternative embodiments of the invention are contemplated which do not depart from the spirit and scope of the invention as defined by the foregoing teachings and appended claims. For example, it is anticipated that in certain circumstances it may be desirable to place the fire protective cover 10 between the inner container 12 and the steel support cage 14 rather than over the steel cage 14. Where there is no support cage, such as with certain fibre, plastic or composite drums, the fire protective cover 10 is placed directly over the container. In still other circumstances, such as when multiple liquid holding containers rest on a single pallet and the containers are not supported by steel cages, a single fire protective cover 10 may be placed directly over all of the multiple containers. It is intended that the claims cover all such modifications that fall within their scope.

We claim as our invention:

1. In combination, a fire protective cover and an intermediate bulk container for holding flammable liquids, the intermediate bulk container comprising an inner plastic container having a top, bottom and vertical sides, wherein the inner plastic container is supported on at least its vertical sides by a rigid cage, the cover having a top and vertical sides and configured to drape over the rigid cage, thus covering the top and sides of the intermediate bulk container forming a five sided cover when draped over the rigid cage.

2. The combination cover and intermediate bulk container of claim 1 wherein the flammable liquid within the inner plastic container acts a heat sink, thereby working in tandem with the cover to keep the inner plastic container below its melting temperature.

3. The combination cover and intermediate bulk container of claim 1 wherein the cover comprises a heat insulating layer and a heat reflective layer adjacent the heat insulating layer, the heat reflective layer being on the side away from the intermediate bulk container.

4. The combination cover and intermediate bulk container of claim 3 wherein the heat reflective layer is metal foil.

5. The combination cover and intermediate bulk container of claim 3 wherein the heat insulating layer is fiberglass.

6. The combination cover and intermediate bulk container of claim 1 further comprising a pallet upon which the intermediate bulk container rests.

7. The combination cover and intermediate bulk container of claim 6 further comprising flame protection means interposed between the inner plastic container and the pallet to prevent direct impingement of flame onto the bottom of the inner plastic container.

8. The combination cover and intermediate bulk container of claim 7 wherein the flame protection means is a molded pulp pad.

9. In combination, a fire protective cover and an intermediate bulk container for holding flammable liquids, wherein the intermediate bulk container comprises a plastic inner container having a top, a bottom and substantially vertical sides, a rigid cage contacting the vertical sides to provide support, and a pallet upon which the inner container rests; the cover being sufficiently thin to facilitate easy installation, removal and storage, and configured to drape over the top and sides of the intermediate bulk container forming a five sided cover when draped over the intermediate bulk container.

10. The combination cover and intermediate bulk container of claim 9 further comprising flame protection means interposed between the plastic inner container and the pallet to prevent direct impingement of flame onto the bottom of the inner plastic container.

11. The combination cover and intermediate bulk container of claim 10 wherein the flame protection means is a molded pulp pad.

12. The combination cover and intermediate bulk container of claim 11 wherein the plastic inner container has a discharge valve located near its bottom and the molded pulp pad comprises a portion extending under the discharge valve to shield the valve from flames during a fire.

13. The combination cover and intermediate bulk container of claim 9 wherein the plastic inner container has a discharge valve located near its bottom and further comprising a second fire protective cover covering the inner container discharge valve.

14. In combination, a fire protective cover and an intermediate bulk container for holding flammable liquids, wherein the intermediate bulk container comprises an inner plastic container formed from non-metallic materials and supported on at least its vertical sides by a steel cage, the cover being sufficiently thin to fit between the inner plastic container and the steel cage to reduce the heat transfer from the steel cage to the inner plastic container during a fire.

15. In combination, a fire protective cover and a container for holding flammable liquids wherein the container is formed of non-metallic materials, the cover comprises a five sided cover comprising a heat insulating layer and a heat reflective layer adjacent the heat insulating layer on the side away from the container, and the cover is configured to drape over the container and is sufficiently thin to allow for easy installation, removal, and storage.

16. The combination cover and container of claim 15 wherein the container is a drum formed of a material selected from the group consisting of fibre, plastic and composite material.

17. An improved intermediate bulk container of the type comprising a plastic inner container and a protective structural metal cage surrounding the plastic inner container, the improvement comprising:

a fire protective cover configured to drape over the plastic inner container between the plastic inner container and the metal cage, and means for allowing water from a water sprinkler system above the intermediate bulk container to pass through the cover and vaporize to steam, thereby cooling the inner plastic container.

* * * * *